United States Patent [19]

Simoneau

[11] Patent Number: 4,751,046

[45] **Date of Patent: * Jun. 14, 1988**

[54] AUSTENITIC STAINLESS STEEL WITH HIGH CAVITATION EROSION RESISTANCE

[75] Inventor: Raynald Simoneau, St. Bruno, Canada

[73] Assignee: Hydro Quebec, Montreal, Canada

[ * ] Notice: The portion of the term of this patent subsequent to May 13, 2003 has been disclaimed.

[21] Appl. No.: 922,404

[22] Filed: Oct. 23, 1986

[30] Foreign Application Priority Data

Jun. 30, 1986 [CA] Canada ..... 512,811

[51] Int. Cl.[4] ..... C22C 38/30; C22C 38/38

[52] U.S. Cl. ..... 420/36; 420/37; 420/56; 420/57; 420/70; 428/638; 428/683; 428/685

[58] Field of Search ..... 420/36, 37, 56, 57, 420/70, 74, 117, 120; 428/683, 685, 638; 219/146.1, 146.23, 146.32

[56] References Cited

U.S. PATENT DOCUMENTS 3,772,005 11/1973 de Barbadillo ..... 420/37
4,588,440 5/1986 Simoneau ..... 420/36

OTHER PUBLICATIONS

"The Role of Twinning in the Cavitation Erosion of Cobalt Single Crystals", S. Vaidya, S. Mahajan and C. M. Preece, published in Metallurgical Transactions A, vol. 11A, Jul. 1980–1139.

"A Deformation-Induced Phase Transformation Involving a Four-Layer Stacking Sequence in a Co-Fe Alloy", D. A. Woodford and H. J. Beattie, published in Metallurgical Transactions, vol. 2-11/71.

*Primary Examiner*—L. Dewayne Rutledge
*Assistant Examiner*—George Wyszomierski
*Attorney, Agent, or Firm*—Foley & Lardner, Schwartz, Jeffery, Schwaab, Mack, Blumenthal & Evans

[57] ABSTRACT

An austenitic stainless steel alloy showing a high cavitation erosion resistance making it particularly useful for the manufacture and/or repair of hydraulic machine components. The alloy consists essentially of from 8 to 30% by weight of Co; from 13 to 30% by weight of Cr; from 0.03 to 2.0% by weight of C; up to 0.3% by weight of N; up to 5.0% by weight of Si; up to 1.0% by weight of Ni; up to 2.0% by weight of Mo; and up to 16% by weight of Mn, the balance being substantially Fe, with the proviso that at least one of the following conditions is satisfied: the amount of C is higher than 0.3%, and/or the amount of Si is higher than 3.0% and/or the amount of Mn is higher than 9.0%. Moreover, the amounts of the above mentioned elements that are respectively known as ferrite formers (Cr, Mo, Si) and as austenite former (C, N, Co, Ni, Mn) and amongst said austenite and ferrite formers, the amount of each of these elements that are respectively known to increase and lower the stacking fault energy, are respectively selected and balanced so that at least 60% by weight of the alloy is, at ambient temperature, in a face centered cubic phase having a stacking fault energy low enough to show a fine deformation twinning under cavitation exposure or, alternatively, to make this face centered cubic phase transformable under cavitation exposure to a hexagonal close pack $\epsilon$-phase and/or a $\alpha$-martensitic phase showing such a fine deformation twinning.

12 Claims, No Drawings

AUSTENITIC STAINLESS STEEL WITH HIGH CAVITATION EROSION RESISTANCE

BACKGROUND OF THE INVENTION (a) Field of the Invention

The present invention relates to an austenitic Co-containing stainless steel alloy having a very high resistance to high intensity cavitation erosion.

(b) Brief Description of the Prior Art

U.S. Pat. No. 4,588,440 issued on May 13, 1986 in the name of the present inventor discloses a soft austenitic Co-containing stainless steel alloy having a very high resistance to high intensity cavitation making it particularly useful for the manufacture and/or repair of hydraulic machine components.

The soft stainless steel alloy disclosed and claimed in the U.S. Pat. No. 4,588,440 is characterized in that, on the one hand, it consists essentially of from 8 to 30% by weight of Co;
from 13 to 30% by weight of Cr;
from 0.03 to 0.3% by weight of C;
up to 0.3% by weight of N;
up to 3% by weight of Si;
up to 1% by weight of Ni;
up to 2% by weight of Mo; and
up to 9% by weight of Mn;

the balance being substantially Fe, and, on the other hand, the amount of the above mentioned elements that are respectively known as ferrite formers (Cr, Mo, Si) and as austenite formers (C, N, Co, Ni, Mn) and, amongst said austenite and ferrite formers the amount of each of the elements that are respectively known to increase and lower the stacking fault energy being respectively selected and balanced so that at least 60% by weight of the alloy is, at ambient temperature, in a metastable, face centered cubic (F.C.C.) phase having a stacking fault energy low enough to make it capable of being transformed under cavitation exposure to a fine deformation twinning, hexagonal close pack (H.C.P.) $\epsilon$-phase and/or $\alpha$-martensitic phase.

As indicated in column 3 of U.S. Pat. No. 4,588,440, the above mentioned composition and the very specific structure of this stainless steel alloy have been "selected" by the inventor after numerous studies and tests carried out following the discovery that soft stainless steel alloys containing as low as 8% by weight of Co have an outstanding cavitation resistance similar to the one obtained with the alloys containing up to 65% by weight of Co, provided that at least 60% of this low Co, stainless steel alloys be at ambient temperature in a metastable, F.C.C. $\alpha$-phase having a stacking fault energy low enough to make it capable of being transformed under cavitation exposure to a H.C.P. $\gamma$-phase and/or to a $\epsilon$-martensitic phase showing a fine deformation twinning.

More particularly, it was then surprisingly discovered that soft Fe-Cr-Co-C alloys showing a fine, cavitation-induced twinning, which twinning is specific to crystals having low stacking fault energy (SFE), resist cavitation in a very efficient manner through the following mechanism:

high strain hardening and strain accomodation, delaying fatigue crack initiation;

extension of planar twinning to the whole surface keeping it quite smooth and flat through an incubation period; and continuous absorption of the incident cavitation energy by the production of high dislocation density and very fine eroded particles, thus leading to very low erosion rates.

SUMMARY OF THE INVENTION

The present invention as disclosed and claimed hereinafter, is based on the discovery that results and advantages similar to those disclosed in U.S. Pat. No. 4,588,440, namely an outstanding cavitation resistance, a relatively low cost of manufacture and a plurality of possible uses especially for the manufacture and repair of hydraulic machine components, can be obtained with a new austenitic Co-containing stainless steel alloy harder than the one disclosed in U.S. Pat. No. 4,588,440, which new alloy contains up to 2% by weight of carbon, up to 5% by weight of silicium and up to 16% by weight of manganese.

The object of the present invention, which object directly derives from the above mentioned discovery, is therefore to provide a new austenitic Co-containing stainless steel alloy having a high cavitation erosion resistance, which new alloy is characterized in that:

(a) it consists essentially of:

from 8 to 30% by weight of Co;
from 13 to 30% by weight of Cr;
from 0.03 to 2.0% by weight of C;
up to now 0.3% by weight of N;
up to 5% by weight of Si;
up to 1.0% by weight of Ni;
up to 2.0% by weight of Mo; and
up to 16% by weight of Mn,
the balance being substantially Fe;

(b) at least one of the following conditions is satisfied:

the amount of C is higher than 0.3%;
the amount of Si is higher than 3.0%;
the amount of Mn is higher than 9.0%; and (c) the amount of the above mentioned elements that are respectively known as ferrite formers (Cr, Mo, Si) and as austenite former (C, N, Co, Ni, Mn) and, amongst said austenite and ferrite formers, the amount of each of these elements that are respectively known to increase and lower the stacking fault energy, are respectively selected and balanced so that at least 60% by weight of the alloy is, at ambient temperature, in a face centered cubic face having a stacking fault energy low enough to show a fine deformation twinning under cavitation exposure or, alternatively, to make this face centered cubic face transformable under cavitation exposure to an hexagonal close pack $\epsilon$-phase and/or a $\alpha$-martensite phase showing such a fine deformation twinning.

As in the case of the alloy disclosed and claimed in U.S. Pat. No. 4,588,440, at least 60% by weight of the alloy according to the invention must be in an austenitic, face centered cubic $\gamma$ phase having the smallest possible stacking fault energy at ambient temperature. This last condition, namely a very low stacking fault energy of the austenitic face centered cubic phase, is a key feature of the invention since it is compulsory that the alloy be capable, under cavitation exposure, to be deformed to show a fine, cavitation-induced twinning and surface work hardening making it very resistant to cavitation erosion. This deformation may be achieved in some cases without change of phase. This deformation may however be also obtained by transformation of the face centered cubic $\alpha$ phase into an hexagonal close pack ε-phase and/or a α-martensitic phase showing the requested fine deformation twinning.

This capacity of getting deformed or transformed under cavitation exposure to show a fine, cavitation-induced twinning is specific to alloys having a low stacking fault energy. To achieve such a low stacking fault energy (SFE), the ability of each element to lower or increase the stacking fault energy of the alloys must be considered, and the respective amounts of the various elements selected to complete the composition of a given alloy according to the invention must, in light of the particular ability of each of said elements, be adjusted to lower the stacking fault energy of the whole composition to a level where fine deformation twinning can be induced by exposure to cavitation. Amongst the above mentioned elements that can be used in the alloys according to the invention, Ni and C are known to increase the S.F.E. while Co, Si, Mn and N are known to lower it. The last mentioned elements should therefore be preferably selected to lower as much as possible the S.F.E. of the alloys. Amongst these last mentioned elements, cobalt is probably the most interesting element in that, in addition to lowering the S.F.E., it also permits to maintain the autenitic phase of the alloy in a stable state over a large range of concentration.

Of course, it is also necessary to select the elements and their respective amounts so that at least 60% of the alloy be actually in an austenitic γ phase. To achieve this particular requirement, the amounts of elements known to the ferrite former (Cr, Mo, Si) and the amounts of elements known to the austenite formers (C, N, Co, Ni, Mn) must be adequately selected and balanced.

The necessity for the alloys according to the invention to show a fine, cavitation-induced, deformation twinning is consistent with the observations made by S. Vaidya et al "The role of Twinning in the cavitation Erosion of Cobalt Single Crystals", Met. Trans. A. vol. 11A, p. 1139, July 1980 who attributed the high cavitation resistance of high Co alloys to their low stacking fault energy and their fine planar deformation twinning. However, the fact that the alloy according to the invention with less than 30% Co and up to 70% Fe shows substantially the same low S.F.E. and fine deformation twinning as the high Co-alloy may appear to be rather surprising in light of the article published by D. A. Woodford et al ("A Deformation-Induced Phase Transformation Involving a Four-Layer Stacking Sequence in Co-Fe Alloy". Met. Trans., 1971, vol. 2, p. 3223), where it was shown that, in Co-Fe alloys, only 15% Fe is sufficient to make the cavitation induced $\gamma \rightarrow \epsilon$ transformation completely vanish. A possible explanation to this particular behavious is that in the alloys according to the invention, chromium has a strong interaction with cobalt and iron to promote the formation of low SFE crystals.

The surface layer of the Fe-Cr-Co-C alloy according to the invention shows, after cavitation exposure, a very fine network of deformation twins in face centered cubic γ phase, hexagonal close pack ε phase or α martensite. The present of this continuous, fine twinning under cavitation exposure explains the high cavitation resistance of the alloy. This fine twinning indeed is an efficient means of absorbing the incident cavitation impact energy. This fine twinning is also an efficient means of strain accomodation avoiding high stress concentration and delaying fatigue crack initiation and propagation. The local high strain hardening associated with the fine twinning promotes the extension of the twinning and hardening to the whole exposed surface at the beginning of cavitation exposure (incubation period). This explains why this surface remains so flat and smooth during the incubation period in contrast with the high surface relief produced in wavy deforming materials. The smoother surfaces indeed are less attacked by the local tangential flow produced by the cavitation implosion. Thus, during the incubation period, the only relief on the Co alloys according to the invention are the fine twinning surface steps. Finally, this very fine twinning leads to very low erosion rate through the removal of very fine particles at the twin intersections. The large quantity of created new surfaces for a given metal loss volume thus produced is another efficient way of absorbing the incipient cavitation energy.

In accordance with a preferred embodiment of the invention, the austenitic, Co-containing stainless steel alloy according to the invention advantageoiusly consists of:

from 10 to 12% by weight of Co;
from 16 to 18% by weight of Cr;
from 0.4 to 0.5% by weight of C;
from 2.5 to 3.5% by weight of Si; and
from 4.5 to 5.5% by weight of Mn;
the balance being substantially Fe, with traces of impurities such as N or Mo of course, the respective amount of each of the above elements is selected and balanced as explained hereinabove.

Particularly preferred alloys according to the invention are those identified by numbers S17, 23 and 59 in the Table given hereinafter. Indeed, these particularly preferred alloys are not only very efficient in that they have a cavitation erosion resistance substantially equal to or even higher (in the particular case of alloy No. S17-3) than the well known STELLITE-6 (Trademark), but they are also very cheap to manufacture, as compared, for example, to the STELLITE alloys which usually contain 60% by weight of Co. In this connection, it may be noted that the composition of the alloys according to the invention is very similar to the composition of the standard 300, Series stainless steel, the only difference being the absence of Ni (known to increase the stacking fault energy) which is replaced by an increased amount of Co (known to lower Fe).

As aforesaid, the stainless steel alloys according to the invention are soft. They are cheaper than the conventional high Co alloys such as STELLITE-6 or STELLITE-21, and have substantially the same outstanding cavitation resistance as these high Co alloys.

As a result, the alloys according to the invention form an economical alternative to the STELLITE-21 type alloys used today for protecting hydraulic machines againsts cavitation erosion. Welding wires or electrodes made of such alloys can be hot and cold rolled and used for cavitation damage field repair. Hydraulic machine components may also be cast directly from such alloys to allow development and fabrication of high cavitation resistance hydraulic machines.

Therefore, another object of the present invention is to provide a stainless steel component for use in the manufacture or repair of a hydraulic machine, which component is made of, or covered with, a stainless steel alloy according to the invention.

The stainless steel components according to the invention have a cavitation resistance at least equal to the components made of the harder STELLITE-1 or -6 alloys. Since the alloy according to the invention is soft, they are much more easily grindable. Actually, they have all the advantages of the components made of the softer, high Co alloys of the STELLITE-21 type, but at lower cost.

Other advantages and features of the present invention will become apparent from the description that follows of tests and experiments carried out by the inventor.

DESCRIPTION OF TESTS AND EXPERIMENTS CARRIED OUT BY THE INVENTOR

Experimental Procedure

High intensity cavitation erosion resistance was measured according to the standard ASTM-G32 ultrasonic cavitation test. Weight losses of 16 mm cylindrical specimens vibrating at 20 k Hz with a double amplitude of 50 um in distilled water at 22° C. were measured every five hours over a period of 25 hours with an electrical balance accurate to 0.1 mg. The materials tested are listed in the following TABLE I with their nominal composition, their hardness and their cavitation erosion rate.

EXPERIMENTAL CONCLUSION

The tests and measurements reported in TABLE I, clearly show that all the experimental alloys according to the invention have a cavitation erosion resistance higher than or equal to the one of STELLITE 21, while having substantially the same hardness. One of the tested alloy according to the invention, namely the one identified as S17-3, has even shown a cavitation erosion resistance higher than the resistance of the STELLITE 6, with a lower hardness.

X-ray diffraction tests and micrographical observations have simultaneously shown that the superior erosion cavitation resistance of the Co-alloys according to the invention can be attributed to the fine network of deformation twins associated with the deformation of the austenitic $\gamma$ phase or its transformation to HCP-$\epsilon$ phase or $\alpha$-martensite under cavitation exposure, such a fine cavitation induced twinning being specific to alloys having a low stacking fault energy.

The fact that no fine twinning and poor cavitation resistance were observed on the experimental alloys disclosed in U.S. Pat. No. 4,588,440, which alloys were mainly ferritic or martensitic before being subjected to cavitation exposure, seems to indicate that the cavitation-induced, phase deformation or transformation from a F.C.C. $\gamma$ phase to a fine deformation twinning H.C.P. $\epsilon$ phase and/or $\alpha$ martensitic phase, is compulsory to obtain a high cavitation resistance. This requirement in turn involves that the alloys according to the invention be mainly in an austenitic phase at ambient temperature.

It is therefore apparent that, just like in the 301 stainless steel, the amount of ferrite formers (Cr, Mo and Si) and of austenite formers (C, N, Co and Ni) contained in the alloys according to the invention must be balanced in such a way as to barely stabilize austenite especially in case of rapid cooling, and simultaneously promote

TABLE I

COMPOSITION AND PERFORMANCE OF TESTED ALLOYS

| identification numbers | CHEMICAL COMPOSITION (% by weight) C | Mn | Si | Cr | Co | Mo | N | Hardness (Rockwell) (RC) | Cavitation erosion rate dm/dt (mg/h) |
|---|---|---|---|---|---|---|---|---|---|
| S17-3 | 0.46 | 5.30 | 3.30 | 16.60 | 11.60 | 0.02 | 0.050 | 29 | 0.78 |
| STELLITE 6 | 1.10 | 1.00 | 0.50 | 28.00 | 60.00 | 0.00 | 0.050 | 40 | 0.80 |
| 23 | 0.41 | 5.00 | 3.50 | 16.40 | 8.00 | 0.00 | 0.042 | 26 | 0.86 |
| 59 | 0.40 | 5.00 | 3.00 | 16.00 | 8.00 | 0.00 | 0.020 | 30 | 0.90 |
| 34 | 0.78 | 0.10 | 1.40 | 18.40 | 8.00 | 0.00 | 0.090 | 34 | 1.00 |
| 40D | 0.90 | 0.10 | 1.10 | 26.00 | 8.00 | 0.00 | 0.010 | 33 | 1.06 |
| S15-4 | 0.45 | 4.90 | 1.70 | 18.10 | 10.00 | 0.02 | 0.050 | 26 | 1.06 |
| 57 | 0.60 | 2.00 | 1.00 | 18.00 | 10.00 | 0.00 | 0.020 | 27 | 1.06 |
| S16-4 | 0.39 | 5.20 | 3.50 | 15.80 | 10.80 | 0.02 | 0.050 | 23 | 1.08 |
| 40B | 1.10 | 0.10 | 1.30 | 25.00 | 8.00 | 0.00 | 0.017 | 31 | 1.11 |
| S17-4 | 0.46 | 4.90 | 3.10 | 16.90 | 11.60 | 0.02 | 0.050 | 26 | 1.11 |
| S6 | 0.27 | 10.20 | 1.36 | 12.90 | 10.40 | 2.60 | 0.078 | 26 | 1.12 |
| 55 | 0.50 | 2.00 | 1.00 | 18.00 | 10.00 | 0.00 | 0.020 | 26 | 1.12 |
| S15-3 | 0.39 | 4.40 | 1.60 | 18.60 | 9.10 | 0.02 | 0.050 | 25 | 1.17 |
| S14 | 0.37 | 5.00 | 0.76 | 19.00 | 11.00 | 0.02 | 0.050 | 26 | 1.18 |
| S8 | 0.34 | 11.40 | 1.25 | 13.50 | 9.90 | 2.50 | 0.050 | 23 | 1.26 |
| 47 | 0.26 | 10.26 | 1.10 | 13.20 | 11.60 | 0.00 | 0.020 | 12 | 1.30 |
| 54 | 0.40 | 2.00 | 1.00 | 18.00 | 10.00 | 0.00 | 0.020 | 26 | 1.32 |
| 24 | 0.41 | 5.50 | 0.00 | 15.10 | 12.00 | 0.00 | 0.040 | 21 | 1.34 |
| S5 | 0.26 | 10.20 | 1.43 | 13.00 | 9.70 | 2.70 | 0.047 | 21 | 1.35 |
| 45 | 0.27 | 10.40 | 1.16 | 12.50 | 7.30 | 0.00 | 0.020 | 15 | 1.36 |
| S7 | 0.31 | 10.70 | 1.23 | 14.20 | 9.00 | 2.50 | 0.050 | 26 | 1.36 |
| 46 | 0.27 | 10.20 | 1.11 | 13.50 | 9.96 | 0.00 | 0.020 | 15 | 1.36 |
| 60 | 0.40 | 2.00 | 3.00 | 16.00 | 8.00 | 0.00 | 0.020 | 30 | 1.37 |
| S2 | 0.11 | 15.80 | 0.55 | 12.80 | 9.10 | 3.30 | 0.057 | 26 | 1.40 |
| # 3742 | 0.32 | 10.90 | 1.18 | 14.50 | 9.30 | 2.40 | 0.050 | 26 | 1.40 |
| S12 | 0.34 | 3.31 | 0.99 | 18.50 | 11.60 | 0.02 | 0.050 | 26 | 1.40 |
| STELLITE 21 | 0.25 | 1.00 | 0.50 | 28.00 | 60.00 | 5.00 | 0.050 | 30 | 1.40 |

The experimental cobalt alloys listed in the above table were prepared by remelting on a water cooled copper plate of a small laboratory arc furnace appropriate mixture of some of the following constituents: carbon steel, 304 stainless steel, STELLITE 21, ferrochromium, electrolytic cobalt, ferromanganese and ferrosilicium. It should be noted that the composition of each of these experimental alloys except, of which, the STELLITES that were tested by way of reference, falls within the above mentioned range of composition of the Co-containing stainless steel alloys according to the invention.

cavitation-induced, $\gamma$ phase deformation or, alternatively, transformation from $\gamma$-phase to $\gamma$-phase or $\alpha$-martensite, the higher cavitation resistance of the alloys according to the invention essentially resulting from its composition where the amount of the elements increasing the SFE, such as, for example, Ni, is reduced as much as possible and replaced by elements lowering the SFE (Co, Si, Mn and N) to provide finer deformation twinning and high surface work hardening.

The soft Co alloys according to the invention can advantageously be used for the manufacture or repair of hydraulic machine components such as turbine, pump, tap and the like. It can be used as protective layer welded onto a core of carbon steel, or cast as such. It can be hot- or cold-formed into sheets, welding wires or electrodes for use in cavitation damage field repair, in replacement of the more expensive STELLITE 21 used for such repair up to now.

It must be noted that no special thermal or mechanical treatment is required in the as-cast or as-welded state for the best cavitation resistance of the Co austenitic stainless steels according to the invention. They can be used as cast, which makes them applicable for welding filler metal. If they must be cold deformed for shaping purposes into flat or wire product for example, then they will require a high temperature annealing treatment as the plain austenitic stainless steels. Their better formability than the Co-based alloys is another economical advantage for the fabrication of welding wires.

What is claimed is:

1. An austenitic stainless steel alloy showing a high cavitation erosion resistance, wherein:

(a) said alloy essentially consists of:
from 8 to 30% by weight of Co;
from 13 to 30% by weight of Cr;
from 0.03 to 2.0 by weight of C;
up to 0.3% by weight of N;
up to 5% by weight of Si;
up to 1.0% by weight of Ni;
up to 2.0% by weight of Mo; and
up to 16% by weight of Mn,
the balance being substantially Fe;

(b) at least one of the following conditions is satisfied:
the amount of C is higher than 0.3%;
the amount of Si is higher than 3.0%;
the amount of Mn is higher than 9.0%; and (c) the amount of the above mentioned elements that are respectively known as ferrite formers (Cr, Mo, Si) and as austenite former (C, N, Co, Ni, Mn) and, amongst said austenite and ferrite formers, the amount of each of these elements that are respectively known to increase and lower the stacking fault energy, are respectively selected and balanced so that at least 60% by weight of the alloy is, at ambient temperature, in a face centered cubic phase having a stacking fault energy low enough to show a fine deformation twinning under cavitation exposure or, alternatively, to make this face centered cubic face transformable under cavitation exposure to an hexagonal close pack $\epsilon$-phase and/or a $\alpha$-martensite phase showing such a fine deformation twinning.

2. An austenitic stainless steel alloy as claimed in claim 1, said alloy consisting essentially of:
from 10 to 12% by weight of Co;
from 16 to 18% by weight of Cr;
from 0.4 to 0.5% by weight of C;
from 2.5 to 3.5% by weight of Si; and
from 4.5 to 5.5% by weight of Mn,
the balance being substantially Fe with, up to trace amounts of Mo and N.

3. A stainless steel component for use in the manufacturing or repair of a hydraulic machine, said component being made of or covered with an austenitic stainless steel alloy showing a high cavitation erosion resistance, as claimed in claim 2.

4. An electrode or welding wire for the manufacture or repair of a hydraulic machine, said electrode or wire being made of an austenitic stainless steel alloy showing a high cavitation erosion resistance, as claimed in claim 2.

5. An austenitic stainless steel alloy as claimed in claim 1, said alloy consisting essentially of:
about 11.6% by weight of Co;
about 16.6% by weight of Cr;
about 0.46% by weight of C;
about 3.3% by weight Si; and
about 1.3% by weight of Mn,
the balance being substantially Fe with up to trace amounts of Mo and N.

6. An electrode or welding wire for the manufacture or repair of a hydraulic machine, said electrode or wire being made of an austenitic stainless steel alloy showing a high cavitation erosion resistance, as claimed in claim 5.

7. An austenitic stainless steel alloy as claimed in claim 1, said alloy consisting essentially of:
about 8% by weight of Co;
about 16.4% by weight of Cr;
about 0.41% by weight of C;
about 3.5% by weight of Si; and
about 5% by weight of Mn,
the balance being substantially Fe with up to trace amounts of Mo and N.

8. A stainless steel component for use in the manufacturing or repair of a hydraulic machine, said component being made of or covered with an austenitic stainless steel alloy showing a high cavitation erosion resistance, as claimed in claim 7.

9. An austenitic stainless steel alloy as claimed in claim 1, said alloy consisting essentially of
about 8% by weight of Co;
about 16% by weight of Cr;
about 0.4% by weight of C;
about 3% by weight of Si;
about 5% by weight of Mn,
the balance being substantially Fe with up to trace amounts of Mo and N.

10. A stainless steel component for use in the manufacturing or repair of a hydraulic machine, said component being made of or covered with an austenitic stainless steel alloy showing a high cavitation erosion resistance, as claimed in claim 9.

11. A stainless steel component for use in the manufacture or repair of a hydraulic machine, said component being made of or covered with an austenitic stainless steel alloy showing a high cavitation erosion resistance, as claimed in claim 1.

12. An electrode or welding wire for the manufacture or repair of a hydraulic machine, said electrode or wire being made of an austenitic stainless steel alloy showing a high cavitation erosion resistance, as claimed in claim 1.

* * * * *